United States Patent [19]

Worrel

[11] 3,994,698

[45] *Nov. 30, 1976

[54] GASOLINE ADDITIVE CONCENTRATE COMPOSITION

[75] Inventor: Calvin J. Worrel, Detroit, Mich.

[73] Assignee: Ethyl Corporation, Richmond, Va.

[ * ] Notice: The portion of the term of this patent subsequent to Apr. 6, 1993, has been disclaimed.

[22] Filed: June 30, 1975

[21] Appl. No.: 591,751

Related U.S. Application Data

[63] Continuation-in-part of Ser. No. 332,641, Feb. 15, 1973, Pat. No. 3,948,619, which is a continuation-in-part of Ser. No. 203,461, Nov. 30, 1971, abandoned, which is a continuation-in-part of Ser. No. 73,265, Sept. 17, 1970, abandoned.

[52] U.S. Cl. ..... 44/58; 44/62; 44/73

[51] Int. Cl.[2] ..... C10L 1/22

[58] Field of Search ..... 44/62, 58, 73, 76, 80; 252/392, 403

[56] References Cited

UNITED STATES PATENTS

| | | | |
|---|---|---|---|
| 2,866,694 | 12/1958 | Glendenning et al. | 44/76 |
| 2,916,451 | 12/1959 | Faust | 44/76 |
| 3,020,134 | 2/1962 | Keller et al. | 44/73 |
| 3,269,810 | 8/1966 | Chamot | 44/73 |
| 3,649,229 | 3/1972 | Otto | 44/73 |
| 3,749,560 | 7/1973 | Perilstein | 44/80 |

*Primary Examiner*—Allen B. Curtis
*Assistant Examiner*—Y. Harris-Smith
*Attorney, Agent, or Firm*—Donald L. Johnson; John F. Sieberth; Robert A. Linn

[57] ABSTRACT

Fuel induction systems of internal combustion engines are cleaned by operating the engine on a gasoline containing a detergent amount of the condensation product of phenol and preferably a high molecular weight alkylphenol, an aldehyde and an amine having a H—N < group. Effectiveness is improved by inclusion of a mineral polyolefin having an average molecular weight of from about 300–2000. The condensation product is also effective in other distillate fuels.

7 Claims, No Drawings

GASOLINE ADDITIVE CONCENTRATE COMPOSITION

CROSS REFERENCE TO RELATED APPLICATIONS

This application is a Continuation-in-Part of application Ser. No. 332,641, filed Feb. 15, 1973, now U.S. Pat. No. 3,948,619, which in turn is a Continuation-in-Part of Ser. No. 203,461, filed Nov. 30, 1971, now abandoned, which in turn is a Continuation-in-Part of Ser. No. 73,265, filed Sept. 17, 1970, now abandoned.

BACKGROUND

Operation of an internal combustion engine over an extended period of time leads to the formation of deposits in the fuel induction system such as the carburetor and around the intake valves. These deposits interfere with the efficient operation of the engine and can lead to lower mileage and increased exhaust emission. In the past, intake system cleanliness has been improved by use of gasoline containing imidazolines and hydrocarbyl amines.

SUMMARY OF THE INVENTION

It has now been discovered that cleanliness of the fuel induction system of an internal combustion engine can be improved by operating the engine on a gasoline containing the condensation product of a phenol and preferably a high molecular weight alkylphenol, an aldehyde and an amine containing at least one H—N< group. The effectiveness of these additives is indeed surprising since they have only found use in lubricating oils (U.S. Pat. Nos. 3,368,972 and 3,413,347).

Description of the Preferred Embodiments

A preferred embodiment of this invention is a liquid hydrocarbon fuel of the gasoline boiling range containing a detergent amount of a gasoline detergent, said detergent being the reaction product of: (A) one mole part of an alkylphenol having the formula:

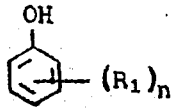

wherein n is an integer from 1 to 2, and $R_1$ is an aliphatic hydrocarbon radical having a molecular weight of from about 400 to 1500; (B) from 1–5 mole parts of an aldehyde having the formula:

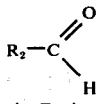

wherein $R_2$ is selected from hydrogen and alkyl radicals containing 1–6 carbon atoms; and (C) from 0.5–5 mole parts of an amine having at least one H—N< group.

Liquid hydrocarbon fuels of the gasoline boiling range are mixtures of hydrocarbons having a boiling range of from about 80° F. to about 430° F. Of course, these mixtures can contain individual constituents boiling above or below these figures. These hydrocarbon mixtures contain aromatic hydrocarbons, saturated hydrocarbons and olefinic hydrocarbons. The bulk of the hydrocarbon mixture is obtained by refining crude petroleum by either straight distillation or through the use of one of the many known refining processes, such as thermal cracking, catalytic cracking, catalytic hydroforming, catalytic reforming, and the like. Generally, the final gasoline is a blend of stocks obtained from several refinery processes. The final blend may also contain hydrocarbons made by other procedures such as alkylate made by the reaction of $C_4$ olefins and butanes using an acid catalyst such as sulfuric acid or hydrofluoric acid.

Preferred gasolines are those having a Research Octane Number of at least 85. A more preferred Research Octane Number is 90 or greater. It is also preferred to blend the gasoline such that it has a content of aromatic hydrocarbons ranging from 10 to about 60 volume percent, an olefinic hydrocarbon content ranging from 0 to about 30 volume percent, and a saturate hydrocarbon content ranging from about 40 to 80 volume percent, based on the whole gasoline.

In order to obtain fuels having properties required by modern automotive engines, a blending procedure is generally followed by selecting appropriate blending stocks and blending them in suitable proportions. The required octane level is most readily accomplished by employing aromatics (e.g., BTX, catalytic reformate or the like), alkylate (e.g., $C_{6-9}$ saturates made by reacting $C_4$ olefins with isobutane using a HF or $H_2SO_4$ catalyst), or blends of different types.

The balance of the whole fuel may be made up of other components such as other saturates, olefins, or the like. The olefins are generally formed by using such procedures as thermal cracking, catalytic cracking and polymerization. Dehydrogenation of paraffins to olefins can supplement the gaseous olefins occurring in the refinery to produce feed material for either polymerization or alkylation processes. The saturated gasoline components comprise paraffins and naphthenes. These saturates are obtained from (1) virgin gasoline by distillation (straight run gasoline), (2) alkylation processes (alkylates) and (3) isomerization procedures (conversion of normal paraffins to branched chain paraffins of greater octane quality). Saturated gasoline components also occur in so-called natural gasoline. In addition to the foregoing, thermally cracked stocks, catalytically cracked stocks and catalytic reformates contain saturated components.

The classification of gasoline components into aromatics, olefins and saturates is well recognized in the art. Procedures for analyzing gasolines and gasoline components for hydrocarbon composition have long been known and used. Commonly used today is the FIA analytical method involving fluorescent indicator adsorption techniques. These are based on selective adsorption of gasoline components on an activated silica gel column, the components being concentrated by hydrocarbon type in different parts of the column. Special fluorescent dyes are added to the test sample and are also selectively separated with the sample fractions to make the boundaries of the aromatics, olefins and saturates clearly visible under ultraviolet light. Further details concerning this method can be found in "1969 Book of ASTM Standards," January 1969 Edition, under ASTM Test Designation D 1319-66T.

The motor gasolines used in formulating the improved fuels of this invention generally have initial boiling points ranging from about 80° to about 105° F. and final boiling points ranging from about 380° to about 430° F. as measured by the standard ASTM distillation procedure (ASTM D-86). Intermediate gasoline fractions boil away at temperatures within these extremes.

From the standpoint of minimizing atmospheric pollution to the greatest extent possible, it is best to keep the olefin content of the fuel as low as can be economically achieved as olefins reportedly give rise to smog-forming emissions, especially from improperly adjusted vehicular engines. Accordingly, in the preferred base stocks of this invention the olefin content will not exceed about 10 volume percent and the most particularly preferred fuels will not contain more than about 5 percent olefins. Table I illustrates the hydrocarbon type makeup of a number of particularly preferred fuels for use in this invention.

TABLE I

Hydrocarbon Blends of Particularly Preferred Base Fuels

| Fuel | Volume Percentage | | |
|---|---|---|---|
| | Aromatics | Olefins | Saturates |
| A | 35.0 | 2.0 | 63.0 |
| B | 40.0 | 1.5 | 58.5 |
| C | 40.0 | 2.0 | 58.0 |
| D | 33.5 | 1.0 | 65.5 |
| E | 36.5 | 2.5 | 61.0 |
| F | 43.5 | 1.5 | 55.0 |
| G | 49.5 | 2.5 | 48.0 |

It is also desirable to utilize base fuels having a low sulfur content as the oxides of sulfur tend to contribute an irritating and choking character to smog and other forms of atmospheric pollution. Therefore, to the extent it is economically feasible, the fuel will contain not more than about 0.1 weight percent of sulfur in the form of conventional sulfur-containing impurities. Fuels in which the sulfur content is no more than about 0.02 weight percent are especially preferred for use in this invention.

Utilization of non-hydrocarbon blending stocks or components in formulating the fuels of this invention is feasible, and in some instances may actually be desirable. Thus, use may be made of methanol, tertiary butanol and other inexpensive, abundant and non-deleterious oxygen-containing fuel components.

It will, of course, be understood that the hydrocarbon fuels used in the practice of this invention will be resistant to oxidative degradation on exposure to air. Through improvements and advances made in refining techniques there is no longer a necessity for relying heavily upon use of catalytically cracked or thermally cracked stocks which tend to be the most oxidatively unstable fuel components. Greater utilization of the more stable components (aromatics and saturates) is now possible and customary. Nevertheless, in any instance where the base fuel has insufficient storage stability in the presence of air, use will be made of an appropriate quantity of an antioxidant. This provides a gasoline of suitable stability for storage, transportation, and use.

The amount of the detergent added to the fuel should be at least sufficient to exert some detergent action in the fuel induction system. In other words, it should be a detergent amount. Detergent action is generally attained when the fuel contains from about 3–2000 ppm (parts per million) of the new detergent; preferably, when it contains from about 3–1000 ppm, and, more preferably, when it contains from about 6–100 ppm. A most preferred concentration range is about 12–50 ppm.

The gasoline may contain any of the other additives normally employed to give fuels of improved quality such as tetraalkyllead antiknocks including tetramethyllead, tetraethyllead, mixed tetraethyltetramethyl lead, and the like. They may also contain antiknock quantities of other agents such as cyclopentadienyl nickel nitrosyl, methylcyclopentadienyl manganese tricarbonyl, and N-methyl aniline, and the like. Antiknock promoters such as tert-butyl acetate may be included. Halohydrocarbon scavengers such as ethylene dichloride, ethylene dibromide and dibromo butane may be added. Phosphorus-containing additives such as tricresyl phosphate, methyl diphenyl phosphate, diphenyl methyl phosphate, trimethyl phosphate, and tris($\beta$-chloropropyl)phosphate may be present. Antioxidants such as 2,6-di-tert-butylphenol, 2,6-di-tert-butyl-p-crseol, phenylenediamines such as N-isopropylphenylenediamine, and the like, may be present. Likewise, the gasoline can contain dyes, metal deactivators, or any of the additives recognized to serve some useful purpose in improving the gasoline quality.

A preferred embodiment of the invention is a liquid hydrocarbon fuel of the gasoline boiling range containing a detergent amount of the new detergent of this invention and from about 0.25 to 4 grams per gallon of lead as tetraethyllead or tetramethyllead. A still further embodiment of the invention is a liquid hydrocarbon fuel of the gasoline boiling range containing a detergent amount of the new detergent of this invention and from about 0.005 to 3, more preferably 0.005 to 0.5, grams of manganese per gallon as methylcyclopentadienyl manganese tricarbonyl.

The detergents are made by condensing a phenol and preferably a high molecular weight alkylphenol, an aldehyde and ammonia or preferably an aliphatic amine having at least one reactive hydrogen atom bonded to nitrogen. In other words, an amine having at least one H—N< group. This reaction is the well-known "Mannich reaction" (see "Organic Reactions," Volume I). The conditions for carrying out such a condensation are well known.

The preferred alkylphenol reactant is an alkylphenol wherein the alkyl radical has an average molecular weight of from about 400 to 1500. In a more preferred alkylphenol reactant the alkyl radical has an average molecular weight of from about 800 to 1300, and in the most preferred alkylphenols the alkyl radical has an average molecular weight of from about 900 to 1100.

Alkylphenols suitable for use in the preparation of the present dispersants are readily prepared by adaptation of methods well known in the art. For example, they may be prepared by the acid catalyzed alkylation of phenol with an olefin. In this method, a small amount of an acid catalyst such as sulfuric or phosphoric acid, or preferably a Lewis acid such as $BF_3$-etherate, $BF_3$-phenate complex or $AlCl_2$—$HSO_4$, is added to the phenol and the olefin then added to the phenol at temperatures ranging from about 0° up to 200° C. A preferred temperature range for this alkylation is from about 25 to 150° C., and the most preferred range is from about 50° to 100° C. The alkylation is readily carried out at atmospheric pressures, but if higher temperatures are employed the alkylation may be carried out at super atmospheric pressures up to about 1000 psig.

The alkylation of phenols produces a mixture of mono-, di- and tri-alkylated phenols. Although the preferred reactants are the mono-alkylated phenols, the alkylation mixture can be used without removing the higher alkylation products. The alkylation mixture formed by alkylating phenol with an olefin using an acid catalyst can be merely water washed to remove the unalkylated phenol and the acid catalyst and then used in the condensation reaction without removing the di- and tri-alkylated phenol products. The di-alkylated phenol enters into the condensation reaction and yields useful gasoline detergents. Another method of removing the unreacted phenol is to distill it out, preferably using steam distillation or under vacuum, after washing out the alkylation catalyst. The amount of di- and tri-alkylated phenols can be kept at a minimum by restricting the amount of olefin reactant added to the phenol. Good results are obtained when the mole ratio of olefin to phenol is about 0.25 moles of olefin per mole of phenol to 1.0 mole of olefin per mole of phenol. A more preferred ratio is from about 0.33 to 0.9, and a most preferred ratio is from about 0.5 to 0.67 moles of olefin per mole of phenol.

The olefin reactant used to alkylate the phenol is preferably a monoolefin with an average molecular weight of from about 400 to 1500. The more preferred olefins are those formed from the polymerization of low molecular weight olefins containing from about 2 to 10 carbon atoms, such as ethylene, propylene, butylene, pentene and decene. These result in polyalkene substituted phenol. A most preferred olefin is that made by the polymerization of propylene or butene to produce a polypropylene or polybutene mixture with an average molecular weight of from about 900–1100. This gives the highly preferred polypropylene and polybutene substituted phenols.

The aldehyde reactant preferably contains from 1 to 7 carbon atoms. Examples are formaldehyde, acetaldehyde, propionaldehyde, butyraldehyde, valeraldehyde, hexaldehyde and heptaldehyde. The more preferred aldehyde reactants are the low molecular weight aliphatic aldehydes containing from 1 to about 4 carbon atoms such as formaldehyde, acetaldehyde, butyraldehyde and isobutyraldehyde. The most preferred aldehyde reactant is formaldehyde, which may be used in its monomeric or its polymeric form such as paraformaldehyde.

The amine reactants include those that contain at least on active hydrogen atom bonded to an amino nitrogen atom, such that they can partake in a Mannich condensation. They may be primary amines, secondary amines or may contain both primary and secondary amino groups. Examples include the primary alkyl amines such as methyl amine, ethyl amine, n-propyl amine, isopropyl amine, n-butyl amine, isobutyl amine, 2-ethylhexyl amine, dodecyl amine, stearyl amine, eicosyl amine, triacontyl amine, pentacontyl amine, and the like, including those in which the alkyl group contains from 1 to about 50 carbon atoms. Also, dialkyl amines may be used such as dimethyl amine, diethyl amine, methylethyl amine, methylbutyl amine, di-n-hexyl amine, methyl dodecyl amine, dieicosyl amine, methyl triacontyl amine, dipentacontyl amine, and the like, including mixtures thereof.

Another useful class is the N-substituted compounds such as the N-alkyl imidazolidines and pyrimidines. Also, aromatic amines having a reactive hydrogen atom attached to nitrogen can be used. These include aniline, N-methyl aniline, ortho, meta and para phenylene diamines, $\alpha$-naphthyl amine, N-isopropyl phenylene diamine, and the like. Secondary heterocyclic amines are likewise useful including morpholine, thiomorpholine, pyrrole, pyrroline, pyrrolidine, indole, pyrazole, pyrazoline, pyrazolidine, imidazole, imidazoline, imidazolidine, piperidine, phenoxazine, phenathiazine, and mixtures thereof, including their substituted homologs in which the substituent groups include alkyl, aryl, alkaryl, aralkyl, cycloalkyl, and the like.

A preferred class of amine reactants is the diamines represented by the formula:

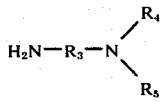

wherein $R_3$ is a divalent alkylene radical containing 1–6 carbon atoms, and $R_4$ and $R_5$ are selected from the group consisting of alkyl radicals containing from 1–6 carbon atoms and radicals having the formula:

$$-R_6-X$$

wherein $R_6$ is a divalent alkylene radical containing from 1–6 carbon atoms, and X is selected from the group consisting of the hydroxyl radical and the amine radical.

The term "divalent alkylene radical" as used herein means a divalent saturated aliphatic hydrocarbon radical having the empirical formula:

$$-C_nH_{2n}-$$

wherein $n$ is an integer from 1 to about 6. Preferably, $R_3$ is a lower akylene radical such as the $-C_2H_4-$, $-C_3H_6-$, or $-C_4H_6-$groups. The two amine groups may be bonded to the same or different carbon atoms. Some examples of diamine reactants wherein the amine groups are attached to the same carbon atoms of the alkylene radical $R_3$ are N,N-dialkyl-methylenediamine, N,N-dialkanol-1,3-ethanediamine, and N,N-di(aminoalkyl)-2,2-propanediamine.

Some examples of diamine reactants in which the amine groups are bonded to adjacent carbon atoms of the $R_3$ alkylene radical are N,N-dialkyl-1,2-ethanediamine, N,N-dialkanol-1,2-propanediamine, N,N-di(aminoalkyl)-2,3-butanediamine, and N,N-dialkyl-2,3-(4-methylpentane)diamine.

Some examples of diamine reactants in which the amine groups are bonded to carbon atoms on the alkylene radical represented by $R_3$ which are removed from each other by one or more intervening carbon atoms are N,N-dialkyl-1,3-propanediamine, N,N-dialkanol-1,3-butanediamine, N,N-di(aminoalkyl)-1,4-butanediamine, and N,N-dialkyl-1,3-hexanediamine.

As previously stated, $R_4$ and $R_5$ are alkyl radicals containing 1 to 6 carbon atoms or alkyl radicals containing 1 to 6 carbon atoms which are substituted with the hydroxyl or amine radical. Some examples of hydroxyl substituted radicals are 2-hydroxy-n-propyl, 2-hydroxyethyl, 2-hydroxy-n-hexyl, 3-hydroxy-n-propyl, 4-hydroxy-3-ethyl-n-butyl, and the like. Some examples of amine substituted $R_4$ and $R_5$ radicals are 2-aminoethyl, 2-amino-n-propyl, 4-amino-n-butyl, 4-amino-3,3-dimethyl-n-butyl, 6-amino-n-hexyl, and the like. Preferred $R_4$ and $R_5$ radicals are unsubstituted alkyl radicals such as methyl, ethyl, n-propyl, isopropyl, sec-butyl, n-amyl, n-hexyl, 2-methyl-n-pentyl, and the like. The most preferred $R_4$ and $R_5$ substituents are methyl radicals.

Some specific examples of diamine reactants are: N,N-dimethyl-1,3-propanediamine; N,N-dibutyl-1,3-propanediamine; N,N-dihexyl-1,3-propanediamine; N,N-dimethyl-1,2-propanediamine; N,N-dimethyl-1,1-propanediamine; N,N-dimethyl-1,3-hexanediamine; N,N-dimethyl-1,3-butanediamine; N,N-di(2-hydroxyethyl)-1,3-propane, diamine; N,N-di(2-hydroxybutyl)-1,3-propanediamine; N,N-di-(6-hydroxyhexyl)-1,1-hexanediamine; N,N-di(2-aminoethyl)-1,3-propanediamine; N,N-di(2-amino-n-hexyl)-1,2-butanediamine; N,N-di(4-amino-3,3-di-methyl-n-butyl)-4-methyl-1,3-pentanediamine; and N-(2-hydroxyethyl)-N-(2-aminoethyl)-1,3-propanediamine.

Another very useful class of amine reactants is the alkylene polyamines which have the formula:

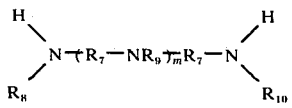

wherein $R_8$, $R_9$ and $R_{10}$ are selected from hydrogen and lower alkyl radicals containing 1–4 carbon atoms, and $R_7$ is a divalent saturated aliphatic hydrocarbon radical containing from 2 to about 4 carbon atoms and m is an integer from 0 to 4. Examples of these are ethylene diamine, diethylene triamine, propylene diamine, dipropylene triamine, tripropylene tetraamine, tetrapropylene pentamine, butylene diamine, dibutylene triamine, diisobutlyene triamine, tributylene tetramine, and the like, including the N—$C_{1-4}$ alkyl-substituted homologs.

A most preferred class of amine reactants is the ethylene polyamines. These are described in detail in Kirk-Othmer, "Encyclopedia of Chemical Technology," Vol. 5, pgs. 898–9, Interscience Publishers, Inc., New York. These include the series ethylene diamine, diethylene triamine, triethylene tetramine, tetraethylene pentamine, pentaethylene hexamine, and the like. A particularly preferred embodiment is a gasoline containing the detergent as described herein in which the amine reactant is a mixture of ethylene polyamines containing a substantial amount of triethylene tetramine and tetraethylene pentamine.

The condensation products are easily prepared by mixing together the alkylphenol, the aldehyde reactant and the amine reactant, and heating them to a temperature sufficient to cause the reaction to occur. The reaction may be carried out without any solvent, but the use of a solvent is usually preferred. Preferred solvents are the water immiscible solvents including water-insoluble alcohols (e.g, amyl alcohol) and hydrocarbons. The more preferred water-immiscible solvents are hydrocarbon solvents boiling from 50° to about 200° C. Highly preferred solvents are the aromatic hydrocarbon solvents such as benzene, toluene, xylene, and the like. Of these, the most preferred solvent is toluene. The amount of solvent employed is not critical. Good results are obtained when from one to about 50 percent of the reaction mass is solvent. A more preferred quantity is from 3 to about 25 percent, and a most preferred quantity of solvent is from about 5 to 10 percent.

The ratio of reactants per mole of alkylphenol can vary from about 1 to 5 moles of aldehyde reactant and 0.5–5 moles of amine reactant. Molar amounts of amine less than one can be used when the amine contains more than one H—N< group, such as in the ethylene polyamines (e.g., tetraethylenepentamine). A more preferred reactant ratio based on one mole of alkylphenol is from 2.5 to 4 moles of aldehyde and from 1.5 to 2.5 moles of amine reactant. A most preferred ratio of reactants is about 2 moles of alkylphenol to about 3 moles of aldehyde to about 2 moles of amine reactant. This ratio gives an especially useful product when the alkylphenol is a polybutene-substituted phenol in which the polybutene group has a molecular weight of about 900–1100, the aldehyde is formaldehyde and the amine is N,N-dimethyl-1,3-propanediamine.

The condensation reaction will occur by simply warming the reactant mixture to a temperature sufficient to effect the reaction. The reaction will proceed at temperatures ranging from about 50° to 200° C. A more preferred temperature range is from about 75° to 175° C. When a solvent is employed it is desirable to conduct the reaction at the reflux temperature of the solvent-containing reaction mass. For example, when toluene is used as the solvent, the condensation proceeds at about 100° to 150° C. as the water formed in the reaction is removed. The water formed in the reaction co-distills together with the water-immiscible solvent, permitting its removal from the reaction zone. During this water removal portion of the reaction period the water-immiscible solvent is returned to the reaction zone after separating water from it.

The time required to complete the reaction depends upon the reactants employed and the reaction temperature used. Under most conditions the reaction is complete in from about one to 8 hours.

The reaction product is a viscous oil and is usually diluted with a neutral oil to aid in handling. A particularly useful mixture is about two-thirds condensation product and one-third neutral oil.

The following examples will serve to illustrate the condensation reaction. All parts are parts by weight unless otherwise indicated.

EXAMPLE 1

To a reaction vessel equipped with a stirrer, condenser and thermometer was added 363 parts of polybutene having an average molecular weight of 1100 and 94 parts of phenol. Over a period of 3 hours, 14.2 parts of a $BF_3$-etherate complex were added while maintaining the reaction temperature between 50° and 60° C. The reaction mixture was then stirred at 55° – 60° C. for an additional 4.5 hours and then transferred to a second reaction vessel containing 750 parts of water. The aqueous phase was removed and the organic phase washed 4 times with 250 parts of water at 60° C., removing the aqueous phase after each wash. The organic product was then diluted with about 200 parts of n-hexane and dried with anhydrous sodium sulfate. The product was then filtered and the hexane and other volatiles removed by vacuum distillation until the product remaining was at 75° C. at 0.3 mm Hg. As a reaction product, there was obtained 368.9 parts of an alkylphenol as a viscous amber-colored oil having an average molecular weight of 810.

In a separate reaction vessel was placed 267 parts of the alkylphenol prepared above, 33.6 parts of N,N-dimethyl-1,3-propanediamine and 330 parts of isopropanol. While stirring, 15.8 parts of 95 percent paraformaldehyde was added. The reaction mixture was then refluxed for 6.5 hours. Following this, the solvent and other volatiles were distilled out to a reaction mass temperature of 115° C. at about 15 mm Hg. The reaction mass was a viscous amber-colored liquid having excellent detergent action in fuel induction systems.

EXAMPLE 2

To a reaction vessel equipped with a stirrer, condenser and thermometer was added 934 parts of a polybutene having an average molecular weight of about 900, 196 parts of phenol and 22 parts of a $BF_3$-ether complex containing 48 percent $BF_3$. The temperature was raised to 60° C. and maintained there for 3 hours, following which 120 parts of water were added. Steam was then injected into the reaction mass, causing the unalkylated phenol to distill out. The steam distillation was continued until almost all the phenol had been removed. About 870 parts of toluene were then added and the organic phase separated and dried over anhydrous sodium sulfate. The toluene was then removed by vacuum distillation until the alkylated phenol reached a temperature of 145° C. at a pressure of 0.2 mm Hg. Infrared analysis for hydroxyl content showed that the product had an average molecular weight of 1060.

To a second reaction vessel equipped with stirrer, condenser and thermometer was added 313 parts of the alkylphenol prepared above, 30.1 parts of N,N-dimethyl-1,3-propanediamine, 14 parts of 95 percent paraformaldehyde and 152 parts of toluene. While stirring, the reaction temperature was raised gradually to 145° C. over a 2.5 hour period. Water was separated from the toluene that distilled out and the toluene distillate was returned to the reaction zone. The volatile material in the reaction product was then removed by maintaining the product at about 140° – 145° C. while reducing the pressure in the reaction system to about 12 mm Hg. The volatiles that distilled out during this period were condensed and removed from the reaction mass, resulting in 352 parts of the condensation product in the form of a viscous oil.

EXAMPLE 3

To a reaction vessel equipped as in Example 1 was added 260 parts of isopropyl alcohol, 266 parts (0.33 mole) of the alkylphenol prepared as described in Example 1 and 45 parts (0.33 mole) of N,N-di(2-hydroxyethyl)-1,3-propanediamine. While stirring, 15.8 parts (0.5 mole) of 95 percent paraformaldehyde were added. The reaction mixture was stirred at reflux for 6.5 hours, following which the solvent and volatiles were distilled out to a liquid temperature of 115° C. at 15 mm Hg., leaving a viscous gasoline soluble residue.

EXAMPLE 4

To a reaction vessel equipped with stirrer, thermometer and condenser is added 3000 parts of an alkylated phenol in which the alkyl group has an average molecular weight of 1500. The phenol is primarily monoalkylated, but small amounts of di- and some tri-alkylphenols are present. Following this, 90 parts of paraformaldehyde, 204 parts of N,N-dimethyl-1,3-propanediamine and 200 parts of toluene are added. While stirring, the temperature is raised to 110° C. Toluene distills together with some water. The water is removed from the toluene distillate and the toluene returned to the reaction zone. Over a 4 hour period, during which time water is continuously removed, the reaction temperature rises to about 145° C. Following this, the toluene and other volatile material is removed by reducing the pressure in the system to about one mm Hg., while maintaining the temperature at about 150° C. and allowing the volatiles to distill out. The resultant product is an excellent gasoline detergent additive.

EXAMPLE 5

To the reaction vessel of Example 3 is added 2000 parts of a primarily monoalkylphenol having an average molecular weight of about 800, 150 parts of paraformaldehyde, 324 parts of N,N-di-(2-hydroxyethyl)-1,3-propanediamine and 200 parts of toluene. While stirring, the reaction temperature is raised to 100° C. over a 0.5 hour period, and then to 140° C. over a 4 hour period. During the time from 100° to 140° C., the water that codistills with the toluene is removed and the toluene returned to the reaction zone. Following this, the volatiles are removed by vacuum distillation to a product temperature of 150° C. at about one mm Hg. The resultant product is an excellent gasoline detergent.

EXAMPLE 6

To a reaction vessel as described in Example 2 is added 1.75 mole parts of a primarily monoalkylated phenol in which the alkyl group is a polypropylene group with an average molecular weight of about 1200. Followig this, there is added 300 parts of toluene, 90 parts of paraformaldehyde and 2.0 mole parts of N,N-di(2-aminoethyl)-1,3-propanediamine. The temperature is raised to 100° C. over a 0.5 hour period and then slowly to 150° C. during the next 3 hours. Water co-distills with the toluene and is removed and the toluene returned to the reaction zone. Following this, the volatiles are removed by vacuum distillation until the reaction mass is at a temperature of 150° C. at about one mm Hg. The product is an effective gasoline detergent.

EXAMPLE 7

In a reaction vessel as described in Example 2 is placed 1093 parts of a polybutene-substituted phenol in which the polybutene group has a molecular weight of 1000. To this is added 1500 parts of xylene, 500 parts of isopropanol and 50 parts of paraformaldehyde (91 percent flake). Then, 200 parts of technical grade tetraethylenepentamine is added and the mixture heated and stirred at reflux for 4 hours while distilling out water of condensation. The solution is then washed and dried over anhydrous calcium sulfate and filtered to give a useful detergent in xylene solution. If desired, the xylene can be distilled out, giving a higher detergent concentrate which can be blended with other adjuvants such as mineral oil or a normally liquid polyolefin oligomer to give a useful concentrate. Other ingredients such as antioxidants, phosphorus additives, metal deactivators, antiknock promoters, and the like, can be added to this, giving a very effective additive package.

Equal mole parts of other ethylenepolyamines such as ethylenediamine, diethylenediamine, triethylenetetramine, pentaethylenehexamine, and mixtures thereof, can be substituted in the above example to obtain a useful detergent. Likewise, any of the other alkylphenols previously described can be used. Other aldehydes such as acetaldehyde, propionaldehyde, butyraldehyde, valeraldehyde, and the like, can be substituted for the formaldehyde with good results.

The foregoing examples serve only to demonstrate some of the methods of preparing the product and not to limit the invention to the specific reactants or reactant ratios shown. Any of the previously-described reactants may be used in the process in the ratios previously set forth.

A highly preferred embodiment of this invention is a liquid hydrocarbon fuel of the gasoline boiling range as previously described containing in addition to the detergent additive a small amount of a mineral oil. This embodiment is particularly advantageous in promoting the cleaning of intake valves and stems. The amount of oil added can be any amount from about 0.05 to about 0.5 volume percent, based on the final gasoline. Although the oil adjuvant can be any of the well-known mineral oils including those obtained from Pennsylvania, midcontinent, Gulfcoast, or California crudes, the more preferred are tha naphthenic mineral oils. The viscosity of the mineral oil can vary from about 70 to 2000 SUS at 100° F.

In another preferred embodiment a synthetic olefin oligomer is used in place of or together with the mineral oil adjuvant. These oligomers are prepared by the polymerization of aliphatic monoolefinic hydrocarbons such as ethylene, propylene, butene, decene-1, and the like. These result in such adjuvants as polyethylene, polypropylene, polybutene, α-decene trimer, α-decene tetramer and mixtures of the proper average molecular weight. Useful polymerization catalysts include both the Lewis acid type such as aluminum chloride, boron trifluoride, etc., as well as the metal alkyl types such as triethyl aluminum, diethyl aluminum chloride, methyl aluminum sesquichloride, diethyl zinc, either alone or in combination with a metal salt modifier such as titanium tetrachloride or cobalt iodide. Means of carrying out the polymerization of the simple olefin monomers are well known.

The polymerization should be carried out until the olefin forms a normally liquid oligomer having an average molecular weight of from about 300 to 2000, especially 350–1500. The oligomers of this molecular weight range have the greatest effect in promoting the cleaning of intake valves when used in combination with a detergent of this invention.

In an especially preferred embodiment the polyolefin adjuvant is a normally liquid olefinic hydrocarbon having an average molecular weight of from about 350 to about 1500 and is made by the polymerization of a mixture of aliphatic monoolefins containing at least 12 carbon atoms. Preferably the monoolefins used to prepare this polyolefin adjuvant contain from about 12–32 carbon atoms and are predominantly alpha olefins. More preferred olefin hydrocarbons are those obtained by polymerizing a mixture of even numbered, predominantly alphamonoolefins having from 12 to about 32 carbon atoms using a Friedel-Crafts catalyst. Preferred Friedel-Crafts catalysts are aluminum chloride, aluminum bromide, and boron trifluoride. Preferred reaction temperatures are 20° C.–120° C. A most preferred polymerization process is carried out at temperatures ranging from about 40° C. to about 110° C., using an aluminum halide catalyst in the absence of any lower alkyl ($C_1$–$C_6$) monohalide.

These poly-$C_{12+}$ olefin adjuvants are non-aromatic, normally liquid olefin hydrocarbons characterized by having an average molecular weight ranging from 350 to about 1500. By normally liquid is meant that the olefin hydrocarbon is fluid at room temperature. These olefin hydrocarbons include cyclic olefin hydrocarbons as well as branched chain and straight chain olefin hydrocarbons.

Although olefin hydrocarbons useful as adjuvants may contain only one carbon number polyolefin, for example, triacontene ($C_{30}$), pentacontene ($C_{50}$), a $C_{100}$ olefin, α-dodecene trimer, α-dodecene tetramer, and the like, preferred poly-$C_{124}$-olefins are made using mixtures of olefins having at least 16 or more and preferably at least 24 or more carbon atoms. The mixtures of olefins which make up these preferred olefin hydrocarbons may be obtained directly from commercial processes such as Ziegler catalyzed ethylene and/or propylene polymerization; dehydrohalogenation of suitable alkyl halides; the catalytic dehydrogenation of suitable paraffins, for example, wax cracked paraffins; or oligomerization of suitable olefins; or other similar processes.

Particularly preferred olefin hydrocarbon additives are those obtained by polymerizing non-aromatic, primarily alpha-monoolefin mixtures having 8 or more, and preferably 12 or more, carbon atoms. By predominantly alpha is meant that more than 50 percent by weight of the monoolefin mixture has the alpha configuration.

The polymerization of these monoolefins can be effected with various catalyst systems. Useful polymerization procedures are disclosed, for example, in U.S. Pat. Nos. 2,620,365; 3,206,523; 3,232,883; 3,252,771; 3,253,052; 3,259,668; 3,261,879; 3,322,848; 3,325,560; 3,330,883; 3,346,662; and 3,450,786. The olefin hydrocarbon products prepared using procedures such as those described in the patents listed are useful as adjuvants together with the detergents of this invention in gasoline provided that the product has the required average molecular weight, is normally liquid, and is non-aromatic in nature.

A most preferred normally liquid non-aromatic olefin hydrocarbon is the product obtained by polymerizing a mixture of even carbon numbered, predominantly alpha monoolefins having from 12 to 32 carbon atoms using a Friedel-Crafts catalyst, preferably selected from aluminum chloride, aluminum bromide, and boron trifluoride, at reaction temperatures ranging from 0° C. to about 145° C. A most preferred polymerization is carried out in the absence of any lower alkyl ($C_1$–$C_6$) halide such as methylchloride, n-hexylchloride, isopropylchloride, ethylchloride, and the like, at temperatures ranging from 20° C.-110° C. $AlCl_3$ and $AlBr_3$ are most preferred catalysts.

The polymerization reaction is ordinarily carried out without the addition of any inert diluent. However, the polymerization can be carried out in the presence of an inert diluent, e.g., an alkane, if desired.

The polymerization reaction time is to a degree dependent on the monoolefin feed stream, the reaction temperature, the catalyst concentration, and the like. For example, when aluminum chloride is used as the catalyst, at a reaction temperature of 70° C. with an olefin feed containing $C_{12}$–$C_{32}$ olefins, a 2-hour reaction time is sufficient. Thus, the reaction time can be adjusted as required to produce the olefin hydrocarbons of the proper molecular weight range to be useful in the present invention.

The preferred Friedel-Crafts catalysts are aluminum chloride, aluminum bromide, and boron trifluoride. The concentration of catalyst used may be varied. Generally, from about 2 percent to about 10 percent of the catalyst, based on the weight of monoolefin charged, can be used. About 5 percent of the catalyst, based on the weight of the olefin charged, is conveniently used.

The preferred monoolefins which can be polymerized using the Friedel-Crafts process described above are mixtures of acyclic monoolefin hydrocarbons having from about 12 to about 32 carbon atoms. These monoolefin mixtures are synthesized by methods known in the art. For example, they may be prepared by cracking wax paraffins; by catalytically dehydrogenating paraffinic hydrocarbons; or by polymerizing low molecular weight monoolefins, such as ethylene, using Ziegler-type catalysts. It is the general nature of these monoolefin preparations that mixtures of monoolefins are obtained. These monoolefin mixtures can vary widely in composition from 100 percent α-monoolefins, through intermediate mixtures, to 100 percent internal monoolefins; mixtures which contain 30 percent or more α-monoolefins are preferred. The range of carbon chain lengths in these mixtures can also vary considerably. Both branched and linear olefins can be present in these mixtures. Useful mixtures can also contain small amounts of monoolefins outside the $C_{12}$–$C_{32}$ range. Mixtures in which α-monoolefins predominate are more preferred; by predominate is meant that more than 50 percent by weight of the olefin mixture is α-monoolefin. In addition to the monoolefins, the mixture can also contain small quantities of certain byproducts (or co-product). The type of by-product or co-product found in the α-monoolefin mixtures will depend to a great degree on the method used to prepare the monoolefins. Thus, for example, if the monoolefin mixture is prepared by catalytic dehydrogenation of paraffins in the $C_{12}$–$C_{32}$ range, the monoolefin mixture may contain some of the starting paraffin, while with Ziegler catalyzed ethylene systems the byproduct present in the monoolefin may be paraffins as well as higher molecular weight alkanols. Generally, the monoolefin mixtures containing these byproducts can be used as such; provided the presence of the by-product does not adversely affect the Friedel-Crafts polymerization reaction and olefin hydrocarbon product.

Examples of useful monoolefin mixtures are those having the following monoolefin composition by weight: 30%, $C_{12}$, 40% $C_{14}$, and 30% $C_{16}$; 10% $C_{13}$, 20% $C_{14}$, 25% $C_{15}$, 25% $C_{16}$, 15% $C_{17}$ and 5% $C_{18}$; 2% $C_9$, 3% $C_{10}$, 5% $C_{11}$, 30% $C_{12}$, 35% $C_{13}$, 20% $C_{14}$ and 5% $C_{15}$; 30% $C_{12}$, 30% $C_{14}$ and 40% $C_{16}$; 1% $C_8$, 2% $C_{10}$, 15% $C_{12}$, 22% $C_{14}$, 24% $C_{16}$, 20% $C_{18}$, 10% $C_{20}$, 4% $C_{22}$ and 2% $C_{24}$; 50% $C_{22}$ and 50% $C_{24}$; 20% $C_{26}$, 60% $C_{28}$ and 20% $C_{30}$; 5% $C_{23}$, 15% $C_{24}$, 30% $C_{25}$, 32% $C_{26}$, 10% $C_{27}$ and 8% $C_{28}$; 11% $C_{16}$, 63% $C_{18}$, 20% $C_{20}$ and 6% $C_{22+}$; 6% $C_{26}$, 15% $C_{28}$, 40% $C_{30}$, 36% $C_{32}$ and 3% $C_{34}$, and the like.

Preferred mixtures of monoolefins contain even carbon numbered olefins ranging from about $C_{12}$ to about $C_{32}$ with an α-monoolefin content of 30 percent or more. These mixtures may contain small amounts of $C_6$, $C_8$ and $C_{10}$ olefins as well as $C_{34+}$ or higher olefins; as well as paraffin and alkanol byproducts as described above.

More preferred mixtures of monoolefins are those containing even carbon numbered olefins, ranging from about $C_{12}$ to about $C_{32}$; the olefins are predominantly α-monoolefins. These mixtures can also contain small amounts of $C_6$, $C_8$ and $C_{10}$ olefins as well as $C_{34}$ and higher olefins; as well as paraffin and alkanol byproducts as described above.

Compositions of typical preferred monoolefin mixtures useful for Friedel-Crafts polymerization are listed in the following table. These preferred monoolefins will be designated herein as $C_{12+}$ monoolefins or $C_{12+}$ monoolefin mixtures.

Table I

| | $C_{12+}$ Monoolefin Mixtures % By Weight[1] | | | |
|---|---|---|---|---|
| Olefin Carbon No. | A | B | C | C'[4] |
| $C_8$–$C_{10}$ | 1.84 | 1.40 | 2.01 | 4.35 |
| $C_{12}$ | 20.39 | 16.72 | 19.40 | 13.92 |
| $C_{14}$ | 12.15 | 9.76 | 12.59 | 9.91 |
| $C_{16}$ | 10.65 | 8.28 | 10.97 | 9.27 |
| $C_{18}$ | 6.29 | 6.34 | 8.88 | 9.51 |
| $C_{20}$ | 4.35 | 4.43 | 5.15 | 6.04 |
| $C_{22}$ | 3.25 | 5.59 | 6.63 | 7.51 |
| $C_{24}$ | 4.38 | 7.50 | 7.70 | 8.21 |
| $C_{26}$ | 3.51 | 6.41 | 4.78 | 5.80 |
| $C_{28}$ | 2.07 | 3.69 | 2.40 | 3.00 |
| $C_{30}$ | 1.33 | 1.25 | 0.90 | 0.61 |
| $C_{32}$ | — | 0.38 | 0.17 | — |
| $C_{34}$ | — | 0.08 | — | — |
| Total Olefins | 70.21% | 72% | 81.58% | 78.13% |
| Total Paraffins | 18.30% | 28% | 18.42% | 21.87% |
| Other By-Products | 11.49%[2] | — | — | — |
| Olefin Configuration % Distribution[3] | | | | |
| α | 69.7% | 60.6% | — | 60.1% |
| Internal | 30.3% | 39.3% | — | 39.9% |

[1]Vapor phase chromatographic analysis
[2]Estimated
[3]Nuclear magnetic resonance analysis
[4]For this mixture, VPC analysis was based on 91.11% recovered normalized. The mixture also contained by-product alcohols.

A typical mixture of $C_{12+}$ monoolefins has the following general composition by weight: $C_8$–$C_{10}$ olefins - 3%, $C_{12}$–$C_{18}$ olefins - 39.2%, $C_{20+}$ olefins - 33.6%, $C_8$–$C_{10}$ paraffins -2%, $C_{12}$–$C_{18}$ paraffins -19.4%, $C_{20+}$ paraffins - 0.8%, alcohols - 2%.

A general composition range for another preferred monoolefin mixture which may be oligomerized to yield a useful adjuvant for the present gasoline detergent comprises a mixture containing by weight 0–3%

$C_{12}$, 8–35% $C_{14}$, 15–30% $C_{16}$, 8–25% $C_{18}$, 4–15% $C_{20}$, 4–15% $C_{22}$, 4–15% $C_{24}$, 0–10% $C_{26}$, 0–10% $C_{28}$, 0–5% $C_{30}$, 0–5% $C_{32+}$; the components being 60–90% olefins (30% or more $\alpha$), 10–35% paraffins and 0–5% alcohols. This type of monoolefin mixture will be designated herein as a $C_{14+}$ monoolefin mixture.

Following is a table of useful $C_{14+}$ monoolefin mixtures.

Table 2

| Olefin Carbon No. | $C_{14+}$ Monoolefin Mixtures D | E | F |
|---|---|---|---|
| $C_{12}$ | 0.1 | 0.3 | 3 |
| $C_{14}$ | 10.4 | 26.5 | 25 |
| $C_{16}$ | 23.3 | 58.0 | 30 |
| $C_{18}$ | 18.3 | 12.9 | 15 |
| $C_{20}$ | 8.5 | — | 8 |
| $C_{22}$ | 8.6 | — | 6 |
| $C_{24}$ | 11.4 | — | 5 |
| $C_{26}$ | 9.9 | — | 3 |
| $C_{28}$ | 5.7 | — | 2 |
| $C_{30}$ | 2.8 | — | 2 |
| $C_{32}$ | 1.0 | — | 1 |
| Olefin Configuration | | | |
| $\alpha$ (Vinyl | 31.6% | — | — |
| (Vinylidene | 29.7% | 50% | 50% |
| Internal | 22.8% | — | — |
| Non-olefin components[1] | 15.9% | 2.3% | 12% |

[1]By-product paraffins and alkanols

Another more preferred monoolefin mixture suitable for oligomerization contains predominantly $\alpha$-monoolefins of even carbon number ranging from $C_{18}$–$C_{28+}$. Again, small amounts of olefins outside this range as well as byproducts can also be present. These preferred monoolefin mixtures will be referred to herein as $C_{18+}$ monoolefins or $C_{18+}$ monoolefin mixtures. A general composition range of these $C_{18+}$ monoolefins is set out in the following table.

Table 3

| Olefin Carbon No. | $C_{18+}$ Monoolefin Composition Range % By Weight[1] |
|---|---|
| $C_{16-}$[2] | 0–6 |
| $C_{18}$ | 0.5–22 |
| $C_{20}$ | 32–55 |
| $C_{22}$ | 18–39 |
| $C_{24}$ | 6–16 |
| $C_{26}$ | 0.5–8 |

Table 3-continued

| Olefin Carbon No. | $C_{18+}$ Monoolefin Composition Range % By Weight[1] |
|---|---|
| $C_{28+}$[3] | 0–10 |
| Paraffins | 0–10 |
| Olefin Configuration % Distribution[4] | |
| $\alpha$ (Vinyl | 30–55 |
| (Vinylidene | 0–55 |
| Internal | 10–70 |

[1]Vapor phase chromatographic (VPC) analysis
[2]$C_{16-}$ includes $C_{16}$ and lower olefins; but essentially no olefins lower than about $C_{12}$
[3]C
[3]$C_{28+}$ includes $C_{28}$ and higher olefins
[4]Nuclear magnetic resonance (NMR) analysis Specific examples of $C_{18+}$ monoolefin compositions are given in the following table.

Table 4

| Olefin Carbon No. | $C_{18+}$ Monoolefin Mixtures % By Weight[1] G | H | I | J | K | L | M | N |
|---|---|---|---|---|---|---|---|---|
| $C_{18-}$ | — | — | 0.17 | 0.08 | 0.08 | 0.41 | 3.0 | 11 |
| $C_{18}$ | 5.06 | 0.50 | 9.50 | 6.19 | 4.34 | 10.83 | 16.7 | 63 |
| $C_{20}$ | 50.12 | 42.66 | 47.69 | 45.79 | 49.31 | 41.06 | 33.2 | 20 |
| $C_{22}$ | 28.55 | 37.10 | 26.85 | 29.58 | 30.31 | 24.42 | 19.6 | 6 |
| $C_{24}$ | 11.33 | 14.38 | 11.19 | 13.56 | 11.75 | 11.56 | 13.2 | — |
| $C_{26}$ | 4.22 | 0.80 | 13.54 | 4.13 | 2.97 | 4.16 | 6.3 | — |
| $C_{28}$ | 0.72 | — | 0.87 | 0.66 | 0.91 | 0.94 | 7.9 | — |
| $C_{30}$ | — | — | 0.19 | 0.01 | 0.28 | — | — | — |
| $C_{32}$ | — | — | — | — | 0.05 | — | — | — |
| Paraffin | — | — | — | — | — | 5.07 | 3.8 | — |
| Olefin Configuration % Distribution[2] | | | | | | | | |
| $\alpha$ (Vinyl | 50.8 | — | 54.0 | 43.3 | 37.7 | 47.4 | 32.2 | 45[3] |
| (Vinylidene | 35.5 | — | 34.0 | 41.5 | 46.7 | 32.2 | 37.3 | 45[3] |
| Internal | 13.8 | — | 12.0 | 15.4 | 15.6 | 20.4 | 30.4 | 10[3] |

[1]Vapor phase chromatographic analysis
[2]Nuclear magnetic resonance analysis
[3]Estimated The more preferred monoolefin mixtures can also be treated with an isomerization catalyst prior to being polymerized. The isomerization effected in this case is primarily isomerization of the vinylidene type $\alpha$-olefins to internal olefins. Thus, for example, isomerizing a more preferred $C_{12+}$ olefin mixture containing 30% vinyl $\alpha$-olefins, 40% vinylidene $\alpha$-olefins, and 30% internal olefins using a suitable catalyst such as silica gel, activated alumina and the like, the isomerized $C_{12+}$ olefin will now contain 30% vinyl $\alpha$-olefins, less than 40% vinylidene $\alpha$-olefins and 30% + internal olefins, the "+" indicating the amount of vinylidene olefin isomerized to internal olefin. Depending on the extent of vinylidene olefin isomerization, the resulting isomerized monoolefin mixture may contain (a) $\alpha$-olefins predominantly, (b) internal olefins predominantly, or (c) an equal amount of $\alpha$-olefins and internal olefins. In any event, such isomerized olefin mixtures containing 30% or more $\alpha$-monoolefins are also useful to prepare the olefin hydrocarbons of the present invention.

The following examples will illustrate the preparation of preferred normally liquid olefin hydrocarbons having a molecular weight of from 350 to 1500 by Friedel-Crafts polymerization of mixtures of $\alpha$-monoolefins of the type disclosed above. All parts are by weight unless otherwise indicated. The molecular weight of the olefin hydrocarbon products was determined by vapor phase osmometry.

EXAMPLE 8

A vessel was charged with 383 parts of a $C_{18+}$ monoolefin mixture. To this olefin mixture was added 20 parts of aluminum chloride, gradually, over a 25-minute period. The vessel was cooled during the addition of the aluminum chloride in order to maintain the temperature of the reaction mixture at less than about 50° C. After the addition of the aluminum chloride was completed, the mixture was heated with stirring at 95° C. for 2 hours. Then, about 100 parts of a 10% HCl solution was added to quench the catalyst. The reaction mixture was then diluted with hexane (to facilitate handling) and it was washed with water until the washings were free of acid. The reaction mixture was then filtered through Celite. The filtrate was stripped of water and solvent under vacuum on a steam bath. The product obtained was 320 parts of a clear yellow slightly viscous liquid. The infrared spectrum of this product indicated it to be a polymerized hydrocarbon. The molecular weight was 818.

Similar results are obtained when aluminum bromide is used in Example 8 in place of the aluminum chloride. The reaction in Example 8 proceeds in an analogous manner when the reaction temperature is 0° C. and the reaction time is 12 hours; when the reaction temperature is 60° C. and the reaction time is 8 hours, or when the reaction time is increased to 3 hours.

EXAMPLE 9

A vessel was flushed with nitrogen and then charged with 454 parts of a $C_{12+}$ monoolefin mixture. The olefin mixture was cooled to 15° C.; 15 parts of aluminum chloride were added to this olefin mixture over a 3–4 minute period. The reaction mixture was then heated with stirring at 70° C. for 2 hours. The catalyst was then quenched by adding about 150 parts of a 10% HCl solution to the mixture. About 350 parts of hexane were added (to facilitate handling) and the diluted mixture was washed with water until the washings were acid free. The reaction mixture was then filtered through Celite. The filtrate was stripped of water and solvent under vacuum on a steam bath. The product obtained was 308 parts of a clear, yellow, very fluid liquid. The molecular weight of this product was 368.

An analogous product is obtained when the reaction of Example 9 is carried out at 0° C. for 16 hours; at 145° C. for 30 minutes; or at 40° C. for 5 hours. Boron trifluoride is used with equal effectiveness in place of aluminum chloride in Example 9.

EXAMPLE 10

A vessel was charged with 589 parts of a $C_{12+}$ monoolefin ,mixture and 16.8 parts of aluminum chloride were added over a 6-minute period. The mixture was then heated with stirring at 110° C. for 3 hours, cooled, diluted with hexane and then it was treated with about 200 parts of a 10% HCl solution. The reaction mixture was then washed with water until the washings were free of acid and then it was filtered. The filtrate was stripped of water and solvent under vacuum to yield 509 parts of a clear, yellow, liquid product. The molecular weight of this product was 378.

A similar reaction is obtained when a $C_{14+}$ monoolefin mixture is used in place of the $C_{12+}$ mixture in Example 10.

EXAMPLE 11

A mixture of 400 parts of a $C_{12+}$ monoolefin mixture and 400 parts of a $C_{18+}$ monoolefin mixture was charged to a flask and cooled to 20° C. This mixture of monoolefins was treated with 40 parts of aluminum chloride, added gradually over a 72-minute period. During the addition of aluminum chloride, the temperature was maintained at 21° C. The reaction was continued with stirring at 22° C.–30° C. for 4 hours. The reaction mixture was then diluted with about 175 parts of hexane and then it was treated with about 200 parts of a 10% HCl solution. The mixture was then washed with water until acid free. It was filtered through Celite and the filtrate was stripped of solvent and water under vacuum. The product obtained was 696 parts of a clear, yellow liquid having a molecular weight of 623.

A similar reaction is obtained when 80 parts of aluminum chloride are used in Example 11. At a reaction temperature of 120° C. analogous results are obtained after a 1 hour reaction period.

EXAMPLE 12

A vessel was charged with 600 parts of a $C_{12+}$ monoolefin mixture. To this olefin mixture was added 17.1 parts of aluminum chloride, gradually, over a 35-minute period. The temperature during this addition ranged from 20°–23° C. The reaction was continued with stirring at 23° C. for 3¾ hours. The mixture was then diluted with about 175 parts of hexane and it was treated with about 250 parts of a 10% HCl solution. The mixture was then washed with water until acid free and it was then filtered through Celite. The filtrate was stripped under vacuum to yield 519 parts of a clear, yellow liquid product having a molecular weight of 366.

In another run, 877 parts of a predominantly $\alpha$, $C_{18}$–$C_{28}$ range monoolefin mixture was polymerized using 75 parts of $AlCl_3$ at 70° C. for 2 hours to produce a useful olefin hydrocarbon additive.

Analogous results are obtained in Example 12 when 12 parts of aluminum chloride, or 12 parts of aluminum bromide, are used as the catalyst; or when the $C_{12+}$ monoolefin mixture is isomerized by contacting the mixture with silica gel for a short period of time.

EXAMPLE 13

The procedure of Example 12 is repeated except that a $C_{14+}$ monoolefin mixture is used and the reaction temperature is increased to 50° C. An analogous olefin hydrocarbon product is obtained, the molecular weight being somewhat higher than 366.

Examples 8–13 illustrate preparations of olefin oligomers which are useful in gasoline to promote cleanliness of the intake valve section of an engine; and as such can be advantageously used in combination with the present novel detergent additives.

Following example illustrates another preparation of the present detergent additives; all parts are by weight.

EXAMPLE 14 i. Preparation of Alkylated Phenyl

A reaction vessel was charged with 56.0 parts of a commercial polybutylene (average molecular weight about 900), 8.6 parts of pre-melted phenol and 20.0 parts of n-heptane. The reaction mass was stirred and heated to 33° C.; and then 2.39 parts of $BF_3$-phenol complex was added over a 16-minute period. The temperature of the reaction mass rose to 49° C. and the mass was stirred under nitrogen for an additional 49 minutes at temperatures ranging from 49°–51° C.

The reaction was quenched by adding 16.5 parts of methanol followed by 9.38 parts of aqueous ammonia to the reaction vessel. Stirring was discontinued and the reaction mass was allowed to separate into two layers. The lower layer was then drawn off and discarded. The alkylated phenol layer remaining in the reaction vessel was washed first with 16.68 parts of water and then it was washed a second time with 16.5 parts of methanol and 12.5 parts of water.

ii. Preparation of Phenol/$CH_2O$/Amine Condensation Product

To the washed alkylated phenol product from (i) was added 6.44 parts of N,N-di-methyl-1,3-propane-diamine and 3.03 parts of 91% paraformaldehyde. The reaction mixture was heated to 35°–37° C. and stirred at this temperature for 35 minutes. The reaction mixture was then heated with stirring to 129° C.; and it was held at 129°–131° C. for two hours. During this heating cycle, water and heptane were distilled off. A sample of the reaction product was taken at this point and labeled Example 14-A product.

About 10 parts of n-heptane were then added to the reaction mixture and the resulting mixture was allowed to cool to about room temperature. This reaction mixture was then heated to 193°–202° C. and maintained with stirring at this temperature for 3 hours and 15 minutes. The solvent was vacuum stripped during the latter portion of this three-hour heating cycle. The reaction mixture was then allowed to cool to 114° C. at which point 33.8 parts of xylene were added. This mixture was stirred and allowed to cool to about room temperature.

The diluted product was then filtered, yielding 88.51 parts of a honey-colored, fluid reaction product. This product was labeled Example 14-B product.

Example 14-A product had a number average molecular weight of 1128 and contained 2.44% of basic nitrogen. The Example 14-B product was analyzed after stripping the xylene; and this product had a number average molecular weight of 1508 and contained 2.02% (82% of theory) basic nitrogen.

Tests have been carried out which demonstrate the detergent properties of the present fuel compositions. These tests show the fuels to be effective not only in cleaning carburetors, but also in removing intake valve deposits. An important feature here is that the additives not only prevent the formation of deposits in clean systems, but will actually remove deposits already present in dirty induction systems. This latter effect is especially important because the fuels can beneficially be used in automotive engines that have already accumulated deposits and thereby the deposits will be removed, resulting in more efficient engine operation and better durability.

Additionally, the use of the gasoline compositions of the present invention also have a beneficial effect in the engine crankcase.

Carburetor Detergency Test

The carburetor of a standard 6-cylinder engine is fitted with a weighed split removable internal throttle-body sleeve. The engine is then operated on a cycle of 5 minutes idle, followed by 70-second part-throttle operation for a total of 2 hours. Blow-by is recycled through the carburetor. Following the test, the sleeve is removed and weighed. Results are reported in terms of percent reduction in deposits compared to that accumulated during operation of the engine for the same length of time but without the test additive.

The results of the carburetor detergency test employing the detergent of Example 2 is shown in the following table.

| Concentration (1) | % Deposit Reduction |
|---|---|
| 30 ppm | 54 |
| 63 ppm | 73 |

(1) Additive concentrate containing Example 2:75 SUS hydrocarbon oil in a weight ratio of about 2:1.

As these results show, the use of the detergent of Example 2 leads to a 54 percent reduction in carburetor deposits employing a concentration of only 30 ppm. At 63 ppm, a reduction of 73 percent was observed.

The mineral oil and polyolefin adjuvants previously described for use in combination with the detergents of this invention function mainly in the area of the intake manifold and intake valves. Use of these materials alone may result in slightly more carburetor deposits. However, when used in combination with the detergents of this invention, carburetor cleanliness is maintained, as shown by the following results obtained using the previous carburetor detergency test, in which the fuel contained an adjuvant amount of a polyolefin prepared as described in Example 9 except having an average molecular weight of 495. In the first test the polyolefin was used alone, and in the second test it was used in combination with the detergent of Example 2 (containing about 33% by weight of a 75 SUS hydrocarbon oil).

| Additive | % Deposit Reduction | |
|---|---|---|
| polyolefin (2000 ppm) alone | 11.5 | % gain |
| polyolefin (2000 ppm) plus detergent of Example 2 (63 ppm) | 73 | % |

As the above results show, even though the polyolefin alone leads to a slight increase in carburetor deposits, this increase is readily offset by the presence of the detergent of Example 2. In fact, the percent deposit reduction at 63 ppm was 73 percent, which is as good as that obtained with the same amount of the same detergent in the absence of the polyolefin.

The results of the carburetor detergency test employing the detergents of Example 14, alone and in combination with an adjuvant amount of a polyolefin (having an average molecular weight of 470) prepared using substantially the same procedure described in Example 9, are shown in the following table.

| Test | Additive | Concentration (ppm) | Deposit Reduction |
|---|---|---|---|
| 1 | Example 14-A (1) | 27 | 62% (2) |

-continued

| Test | Additive | Concentration (ppm) | Deposit Reduction |
|---|---|---|---|
| 2 | Example 14-B | 21 | 55%(2) |
| 3 | Example 14-B | 10 | 55%(2) |
| 4 | Example 14-B | 20 | |
| | + polyolefin | 400 | 59% |
| 5 | Example 14-B | 50 | |
| | + polyolefin | 400 | 52% |
| 6 | Example 14-B | 10 | |
| | + Polyolefin | 400 | 51%(2) |

(1) Diluted with xylene (2 parts Example 14-A product: about 1 part xylene)
(2) Average of two runs The data clearly shows the effectiveness of the present detergent additives in varying concentrations as carburetor detergents — either alone or in combination with an adjuvant.

Intake Valve Clean-Up Test

A standard 6-cylinder automotive engine is operated for 30 hours on a cycle known to cause severe intake valve deposit formation. The cycle consists of running the engine 150 seconds at 2000 rpm, followed by 40 seconds at 500 rpm. The fuel is a commercial gasoline containing 3 grams of lead per gallon as a commercial tetraethyllead antiknock fluid. At the end of the 30 hours the intake valves are removed and weighed. The engine is then reassembled and run for an additional 30 hours using the same cycle and using the same fuel except containing the additive under test. The valves are again removed and weighed. Results are reported in terms of percent reduction in intake valve deposits due to the additive.

The following results were obtained in three tests employing a polyolefin adjuvant alone and in combination with an additive of the present invention as indicated.

| Additive | Conc. (ppm) | % Clean-up |
|---|---|---|
| polyolefin of Example 9 | 1000 | 61 |
| polyolefin of Example 9 | 1000 | |
| detergent of Example 2* | 250 | 73 |
| polyolefin of Example 9 | 1000 | |
| detergent of Example 2* | 1000 | 87 |

*concentrate containing 2 parts Example 2 additive; 1 part 75 SUS oil

As the above results show, although the polyolefin was fairly effective in cleaning deposit-laden intake valves, its effectiveness was significantly increased by use of the present detergent. The net result is that the detergent of this invention provides a means of not only maintaining a clean carburetor, but also functions to maintain a clean induction system and, in fact, when used with an engine that has already accumulated induction system deposits, the additive provides a means for cleaning up these deposits. The overall result is that the entire fuel induction system is maintained much cleaner, providing more efficient engine operation.

Engine Crankcase Deposits

The CRC L-43 test is a single cylinder engine research technique used to study the low temperature deposit forming properties of engine crankcase lubricants. The L-43 test procedure provides that the engine be operated at constant speed and load, but with coolant temperature cycling. The lubricant's sludge and varnish forming tendencies are judged by visual observation of the amount of deposit found on certain engine parts after a given period of engine operation. Following are the results of L-43 tests showing the effect in the crankcase of gasoline containing the present detergent additive.

L-43 Deposit Rating

| Concentration of Example 14-B Additive in the Gasoline | | None | 100 ppm |
|---|---|---|---|
| Sludge[1] | | | |
| Valve Cover | | 5.7 | 8.0 |
| Push Rod Cover | | 7.4 | 8.0 |
| Rocker Arm Assembly | | 7.0 | 10.0 |
| Lower Cylinder | | 5.3 | 10.0 |
| Timing Gear Cover | | 6.7 | 10.0 |
| | Average | 6.4 | 9.2 |
| Hours to 9.5 Average Sludge Rating | | 86 | 116 |
| Varnish[1] | | | |
| Valve Cover | | 8.5 | 8.0 |
| Push Rod Cover | | 8.0 | 8.0 |
| Crankcase Side Plate | | 8.0 | 9.0 |
| | Average | 8.1 | 8.3 |

[1]Rated after 120 hours of engine operation using Standard CRC rating procedure; 10 = clean As the data clearly shows, the present detergent additive also reduces the deposit buildup in parts of the engine other than the intake system and the carburetor. This is indicated by the reduced sludge rating for the run using gasoline containing 100 ppm of Example 14-B; and also by the greater amount of time (116 hours vs. 86 hours) required for deposits to form in the engine. Thus the present additive functions as a multipurpose detergent additive.

The additives of this invention can be added directly to gasoline or they can be added in the form of a concentrate. Thus, another embodiment of the invention is a gasoline detergent concentrate containing an additive amount of a detergent of this invention and a diluent. The amount of detergent in the concentrate can vary from about 0.1–90 weight percent. The diluent serves to maintain the concentrate in a liquid form making it easy to handle and to meter into gasoline blending systems. Preferred diluents are hydrocarbons including both aliphatic and aromatic hydrocarbons such as hexane, heptane, octane, petroleum ether, kerosene, benzene, toluene, xylene, and the like, including mixtures thereof. Thus, the amount of detergent in the concentrate, using a preferred diluent, ranges from 10–90% and preferably from 35 –75%. A more preferred diluent is a higher boiling hydrocarbon such as a mineral oil or polyolefin oligomer. The advantage of using these higher boiling hydrocarbon diluents is that these higher boiling hydrocarbons also serve as the previously-described mineral oil or polyolefin adjuvants. Thus, a more preferred concentrate contains from about 0.1–75 weight percent, preferably about 0.2–50 weight percent, more preferably about 0.3–35 weight percent, and most preferably about 1–20 weight percent of the detergent in a mineral oil or polyolefin oligomer diluent. When this concentrate is added to gasoline a fuel is provided which will maintain the entire induction system in a high degree of cleanliness. Concentrates containing a combination of these detergents can also be used.

Especially good results have been obtained when the hydrocarbon diluent employed in the concentrate is one of the previously-described polyolefin oligomers made by polymerizing an olefin or mixture of olefinic hydrocarbons containing about 12 or more carbon atoms, preferably from 12–32 carbon atoms, to produce a liquid olefin polymer having an average molecular weight of about 300–1500.

The detergent concentrate can contain other additives normally used with gasoline, forming an additive "package." For example, the concentrate can contain gasoline antioxidants such as 2,6-tert-butylphenol, mixtures of butylated phenol containing about 75 percent of 2,6-di-tert-butylphenol, 15 percent o-tert-butylphenol, N-isopropylphenylenediamine; phosphorus additives such as tricresylphosphate, trimethylphosphate, phenyldimethylphosphate, dimethylphenylphosphate, tris($\beta$-chloropropyl)phosphate, and the like; antiknock promoters such as tert-butyl acetate; deicers such as methanol, isopropanol, n-butanol, isobutanol; tetraalkyllead antiknocks such as tetraethyllead, tetramethyllead, redistributed tetraethyltetramethyllead, and the like; scavengers such as ethylene dichloride, ethylene dibromide, dibromobutanes, and the like; other antiknock agents such as methyl cyclopentadienyl manganese tricarbonyl, ferrocene, methyl ferrocene, cyclopentadienyl nickel nitrosyl, N-methylaniline, and the like; metal deactivators such as N,N'-disalicylidene-1,2-diaminopropane; dyes; corrosion inhibitors, and the like.

The concentrates of this invention are readily prepared by merely blending the ingredients until a homogenous solution is obtained. The following examples illustrate the preparation of some typical concentrates.

EXAMPLE 15

To a blending vessel is added 1000 parts of the detergent product from Example 2 and 1000 parts of a naphthenic mineral oil. The mixture is warmed and stirred until homogeneous, forming an additive concentrate useful for improving the detergent properties of gasoline.

EXAMPLE 16

To a blending vessel is added 1000 parts of the detergent additive from Example 7 and 1500 parts of the olefin oligomer from Example 9. Then, 20 parts of a mixture of butylated phenols containing about 75 percent 2,6-di-tert-butylphenol are added. This mixture is stirred, forming a detergent package which also imparts antioxidant protection when added to gasoline.

EXAMPLE 17

A concentrate is prepared by blending 5 parts of the Example 14-B product and 95 parts of a gasoline compatible hydrocarbon.

EXAMPLE 18

A concentrate is prepared by blending 10 parts of the Example 14-B product and 80 parts of a $C_6$–$C_8$ aromatic hydrocarbon.

EXAMPLE 19

A concentrate is prepared by blending 50 parts of the Example 14-B product with 2 parts isopropanol and 48 parts of $C_6$–$C_{10}$ alkane.

EXAMPLE 20

A series of concentrates are prepared by blending 400 parts of polyolefin of the Example 9 type with 1, 3, 5, 10, 12, 20, 36, 50, 70, and 100 parts of the Example 14-B product.

EXAMPLE 21

The following series of concentrates are prepared: 400 parts Example 9 polyolefin and 5 parts Example 2 product plus 400 parts benzene; 600 parts Example 9 type polyolefin (avg. M.W. = 420) plus 60 parts Example 14-A product plus 220 parts toluene; 200* Example 9 type polyolefin, 2.5 parts of Example 14-A product, plus 600 parts hexane; 2000 parts of said polyolefin oligomer and 5 parts of an Example 2 type additive; 100 parts of said polyolefin oligomer and 100 parts of an Example 14-B type additive; 100 parts of said polyolefin oligomer and 300 parts of an Example 2 additive.

*parts

EXAMPLE 22

The following concentrates were prepared. Parts are by weight.

| Concentrate | Additive of Example 14-B | Example 9 Type Oligomer (M.W. = 470) |
|---|---|---|
| 22A | 1 part | 8 parts |
| 22B | 1 part | 20 parts |
| 22C | 1 part | 4 parts |

The amounts of each ingredient in the foregoing compositions can be varied within wide limits to provide the optimum degree of each property.

Gasoline compositions of this invention can be prepared by merely adding the detergent in the proper amount to the gasoline base stock and stirring until dissolved. Likewise, the detergent can be injected into the gasoline stream in an in-line blending system either alone or in combination with other additive such as tetraalkyllead antiknocks. Similarly, the additive concentrate can be added to gasoline, furnishing not only the detergent but also the adjuvant (mineral oil or olefin oligomer). If desired, the detergent and adjuvant can be separately added to the base gasoline.

The following examples serve to illustrate the manner in which gasoline compositions of this invention are made. In these examples the gasoline base stocks have the following composition and properties.

| | | Boiling Range (° F.) | | Composition | | |
|---|---|---|---|---|---|---|
| Fuel | RON | Initial | End point | % Aromatics | % Olefins | % Saturates |
| A | 91 | 91 | 390 | 40 | 1.5 | 58.5 |
| B | 86 | 100 | 400 | 35 | 2 | 63 |
| C | 87 | 95 | 410 | 36.5 | 2.5 | 61 |
| D | 95 | 89 | 395 | 49.5 | 2.5 | 48 |

-continued

| Fuel | RON | Boiling Range (° F.) Initial | End point | Composition % Aromatics | % Olefins | % Saturates |
|---|---|---|---|---|---|---|
| E | 97 | 105 | 415 | 54 | 1.5 | 44.5 |
| F | 90 | 96 | 389 | 39 | 3 | 58 |
| G | 94 | 87 | 395 | 51 | 0.5 | 48.5 |

EXAMPLE 23

In a blending vessel is placed 10,000 gallons of Gasoline A, 25 pounds of the detergent of Example 2, 100 pounds of the poly-$C_{18+}$ olefin of Example 8, 96.5 pounds of tetraethyllead as a commercial antiknock fluid containing one theory of ethylene dichloride and 0.5 theory of ethylene dibromide, and 15.5 pounds of tricresylphosphate. The mixture is stirred until thoroughly mixed. The resultant gasoline is a premium grade gasoline with good detergent properties.

EXAMPLE 24

In a blending vessel is placed 10,000 gallons of Gasoline E, 2.5 pounds of detergent of Example 3, and 50 pounds of a neutral mineral oil (viscosity 100 SUS at 100° F.). The mixture is stirred, resulting in an unleaded gasoline having good detergent properties.

EXAMPLES 25–34

The above Examples 23 and 24 are repeated using each of Gasolines B, C, D, F, and G.

EXAMPLE 35

To a blending vessel is added 10,000 gallons of Gasoline B, 100 pounds of the additive package of Example 16, 84 pounds of tetraethyllead as a commercial antiknock fluid, and 4.8 pounds of trimethylphosphate. The mixture is stirred, giving a high quality gasoline of good detergent properties.

EXAMPLE 36

To Gasoline B is added 5 ppm of the Example 14-B product. The resultant composition has good detergency properties.

EXAMPLE 37

To Gasoline F is added 5 ppm of the Example 2 product and 1000 ppm of a polyolefin having an average molecular weight of 1500. The gasoline blend has good detergency properties.

EXAMPLE 38

A series of gasoline compositions is prepared by blending 3, 7, 12, 18, 25, 36, 50, 90, 140, and 250 ppm of the Example 14-B product with each of Gasoline A-G.

EXAMPLE 39

A series of gasoline compositions is prepared by blending from 400-1200 ppm each of the Example 21 series of concentrates with Gasolines A–G.

EXAMPLE 40

Another series of gasoline compositions are prepared by blending 200, 500, and 1000 ppm of a polyolefin having an average molecular weight of 350–480 and prepared substantially the same as Example 9.

Any of the gasoline compositions can additionally contain from 0.1–3 grams per gallon of an organometallic antiknock, e.g., tetraethyllead, tetramethyllead, (methylcyclopentadienyl)manganese tricarbonyl, as well as required amounts of halohydrocarbon scavengers.

Thus, the gasoline compositions of the present invention can contain from about 2.5–2000 ppm and preferably from about 5–500 ppm, and more preferably from about 10–100 ppm of the detergent additive, i.e. the phenol/aldehyde/amine reaction product disclosed herein. The gasoline composition can additionally and advantageously contain from about 2.5–2000 ppm of an adjuvant, as herein described. More preferred gasoline compositions contain from about 2.5–50 ppm of the detergent and from about 400–1000 ppm of the polyolefin adjuvant having an average molecular weight of about 350–1500, and preferably from about 350–500. Useful polyolefin adjuvants are also described in U.S. Pat. No. 3,502,451, issued Mar. 24, 1970.

Another embodiment of this invention is a liquid hydrocarbon fuel of the gasoline boiling range containing a detergent amount of a reaction product of i. a phenol having the formula

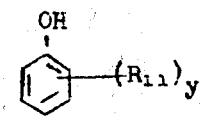

where $R_{11}$ is hydrogen or lower alkyl and $y$ is 1 to 2, ii. an aldehyde, as described above, and iii. an amine having at least one $R_{12}$-N-H group where $R_{12}$ is an alkyl group having about 30 or more carbon atoms.

Suitable products are prepared when the molar ratios of i:ii:iii reactants is 1:1–3:0.5–3.

Phenols useful to prepare this reaction product are phenol and low molecular weight alkyl phenols. By low molecular weight is meant alkylphenols where the alkyl substituents have a molecular weight substantially below 400. The $C_1$–$C_4$ alkyl phenols are preferred reactants. Examples of these phenols are o-cresol, p-cresol, 2,4-dimethylphenol, 2,4-di-n-propylphenol, 2,6-diethylphenol, 4-tert-butylphenol, 2-methyl-4-isopropylphenol, mixtures of these phenols and the like. The monoalkylated phenols of this type are more preferred.

Useful aldehyde reactants are selected from $C_1$–$C_6$ alkanols. Formaldehyde or paraformaldehyde is a preferred reactant.

The amine reactant is one having at least one $R_{12}$-N-H group where $R_{12}$ is an alkyl group having about 30 or more carbon atoms. In other words, useful amine reactants are high molecular weight alkylamines having primary, secondary or combinations of primary and secondary amino groups. These amines include monoamines as well as polyamines.

Useful primary and secondary monoamines have already been described above on Page 10. Additional illustrative examples of useful high molecular weight monoamines are $C_{30}H_{61}$—NH—$CH_3$, $C_{40}H_{81}$—$NH_2$, $C_{50}H_{101}$—NH—$C_{12}H_{25}$, triacontyloleylamine, $C_{45}H_{91}$—$NH_2C_{32}H_{65}$—NH—$C_4H_9$, $(C_{30}H_{61})_2$ NH and the like.

Useful high molecular weight polyamines are represented by the formula $$R_{12}—NH—L$$

where L is selected from $$-(CH_2)_m N(H_{13})_2$$

where $m$ is 2–6 and $R_{13}$ is hydrogen or $C_1$–$C_{30}$ alkyl;

$$—(C_2H_4\text{-}NH)_z R_{13}$$

where $z$ is 2–6.

Examples of useful high molecular weight polyamines are $C_{30}H_{61}—NH—(CH_2)_2—NH_2$
$C_{35}H_{71}—NH—(CH_2)_6—NH_2$
$C_{40}H_{81}—NH—(CH_2)_3—N(CH_3)_2$
$C_{37}H_{75}—NH—(CH_2)—N(CH_3)(C_4H_9)$
$C_{43}H_{87}—NH—(CH_2)_4—NH—C_{30}H_{61}$
$C_{50}H_{101}—NH—(CH_2)_2—NH—C_{18}H_{35}$
$C_{30}H_{61}—NH(C_2H_4—NH)_2H$
$C_{32}H_{65}—NH(C_2H_4—NH)_4CH_3$
$C_{38}H_{77}—NH(C_2H_4—NH)_3C_{12}H_{25}$
$C_{60}H_{121}—NH(C_2H_4—NH)_6C_{30}H_{61}$
and the like.

Amines derived from polymers of $C_2$—$C_4$ monomers, where the polymer has an average molecular weight of 400–1500 are especially useful reactants. Highly branched polyethylene amines, polypropylene amines, and polybutylene amines are especially useful. U.S. Pat. No. 3,438,757, issued Apr. 15, 1969, also describes useful high molecular weight amine reactants.

The reaction parameters for preparing the condensation products of low molecular weight phenols/aldehydes/high molecular weight amines are substantially the same as those already described for the high molecular weight phenol/aldehyde/amine condensation products.

The low molecular weight phenol/aldehyde/high molecular weight amine condensation products are effective as carburetor detergents in gasolines at concentrations ranging from about 3–2000 ppm, preferably from 3–1000 ppm, more preferably from about 6–100 ppm, and most preferably from about 12–50 ppm. Again, these condensation products can be used with the adjuvants disclosed above in substantially the same concentrations as disclosed above. Additive concentrates containing from 0.1–90% by weight of the low molecular weight phenol/aldehyde/high molecular weight amine product in the gasoline compatible diluents described above can also be prepared. These additive concentrates can also contain the oligomer or hydrocarbon oil adjuvants in the concentration ranges disclosed above.

As described above, additive concentrates can be prepared containing an alkylphenol/aldehyde/amine condensation product and preferably a hydrocarbon diluent. Useful additive concentrates can also advantageously contain alkanol having 6 or more carbon atoms. These concentrates will be referred to as Type A concentrates. This alkanol may be individual alkanol such as n-hexanol, heptanol, dodecanol, 2-ethylhexanol, cyclohexanol and the like or a mixture of such alkanols. Normal monoalkanols are preferred. An especially useful alkanol is a mixture containing $C_6$, $C_8$ and $C_{10}$ normal alkanols. Useful Type A concentrates can contain from 10–90% by weight of the aforesaid condensation product, 10–90% by weight of hydrocarbon diluent as described above and 0–35% by weight of alkanol having 6 or more carbon atoms. Preferred Type A concentrates will contain 10–90% by weight of said condensation product. 5–85% by weight of aromatic hydrocarbon and 5–35% by weight of said alkanol. More preferred Type A concentrates will contain 22–66% by weight of said condensation product, 20–33% by weight of aromatic hydrocarbon and 5–35% by weight of said alkanol, and preferably a mixture containing $C_6$, $C_8$ and $C_{10}$ normal alkanols. These concentrates can also contain, if desired, other additives, especially corrosion inhibitors (up to 8% by weight) and demulsifiers (up to 3% by weight). A useful corrosion inhibitor is described in U.S. Pat. No. 2,632,694. Useful demulsifiers are described in U.S. Pat. Nos. 3,265,474, 3,578,422, 3,687,645, and British Pat. No. 1,252,404.

Besides the alkylphenol/aldehyde/amine condensation product, the hydrocarbon and the $C_6$ and higher alkanol components, additive concentrates can also be prepared additionally containing normally liquid hydrocarbon polyolefin having an average molecular weight of 300–2000. These concentrates will be referred to as Type C concentrates. Preferred polyolefin is that having an average molecular weight of about 500–2000, which is prepared from $C_2$–$C_6$ monoolefins. Such preferred polyolefins are described in U.S. Pat. No. 3,502,451.

In the Type C additive concentrates, the composition is as follows:

| Type C Additive Concentrate | Weight % |
|---|---|
| Condensation product | 0.8 – 30 |
| Hydrocarbon diluent | 0.5 – 12 |
| $C_6$ and higher alkanol | 0.1 – 12 |
| Polyolefin (or mineral oil) | 50 – 98 |

More preferred Type C concentrates have the following make up:

| Type C Additive Concentrate | Weight % |
|---|---|
| Condensation product | 1 – 25 |
| Hydrocarbon diluent | 0.8 – 9 |
| $C_6$ and higher alkanol | 0.5 – 9 |
| Polyolefin | 60 – 97 |

In most preferred Type C concentrates, the hydrocarbon diluent is primarily aromatic, the alkanol is a mixture containing $C_6$, $C_8$ and $C_{10}$ primary linear alkanols, and the polyolefin is a polybutene having an average molecular weight of 850–1050.

The Type A additive concentrates are useful in liquid hydrocarbon fuels generally, i.e. fuels of the gasoline boiling range and the distillate fuel boiling range (300° F.–1000° F.), including residual fuels. The Type A concentrates are added to these fuels at concentrations sufficient to effect detergent or dispersant action in the engine or other system in which the fuel is utilized. Generally, concentrations of from about 5 to 2000 parts per million by weight (ppm), and preferably 15–200 ppm are used.

Where the concentrate is of Type C, although it may also be used in liquid fuels generally, it is especially useful in fuels of the gasoline boiling range — and at concentrations of from about 100 to 2000 ppm and preferably from about 400 to about 1000 ppm.

To illustrate the effectiveness of the Type A and Type C concentrates, following are carburetor detergency results obtained with representative gasoline compositions.

Table A

| Carburetor Detergency[1] | | | |
|---|---|---|---|
| Test | Additive Concentrate | Concentration in Gasoline | % Reduction in Deposits |
| 1 | Type A[2] | 30 ppm | 55 |
| 2 | Type A | 150 ppm | 65 |
| 3 | Type C[3] | 750 ppm | 58 |

[1]Test procedure described above
[2]Type A - condensation product of Example 2 type + commercial $C_6$, $C_8$, $C_{10}$ alkanol mixture + commercial aromatic hydrocarbon mixture commerical demulsifier < 8% + commercial corrosion inhibitor <10%
[3]Type B - Type A + polybutene, about 925 molecular weight The gasoline compositions of Test 1, 2 and 3 also have anti-icing effectiveness. Test 3 gasoline also substantially reduces intake valve deposits.

Another type of concentrate containing the alkylpnenol/aldehyde/amine condensation product and additionally containing normally liquid hydrocarbon polyolefin having an average molecular weight of 300–2000 will be referred to as Type D concentrates. Preferred polyolefin is that having an average molecular weight of about 500–2000, which is prepared from $C_2$–$C_6$ monoolefins. Such preferred polyolefins are described in U.S. Pat. No. 3,502,451. A most preferred polyolefin is polybutene. These Type D concentrates additionally contain a hydrocarbon diluent and a $C_6$ and higher alkanol.

In the Type D additive concentrates, the composition is as follows:

| Type D Additive Concentrate | Weight % |
|---|---|
| Condensation product | 0.20 – 90 |
| Hydrocarbon diluent | 0.5 – 90 |
| $C_6$ and higher alkanol | 0.1 – 60 |
| Polyolefin | 8 – 98 |

More preferred Type D concentrates have the following makeup (in weight %): from about 20% to about 60% of Condensation product, from about 5% to about 45% of Hydrocarbon diluent, from about 5% to about 45% of $C_6$ and higher alkanol, and from about 45% to about 85% of Polyolefin.

In the most preferred Type D concentrates, the hydrocarbon diluent is primarily aromatic, the alkanol is a mixture containing $C_6$, $C_8$ and $C_{10}$ primary linear alkanols, and the polyolefin is a polybutene having an average molecular weight of 850–1050. The Type D concentrates can also contain antirust agents, preferably in the range of from about 0.1 to about 10 weight percent, preferably from 0.1 to about 5 weight percent, and a demulsifier in the range of from about 0.1 to about 10 weight percent, preferably from 0.1 to about 5 weight percent.

Where the concentrate is of Type D, although it may be used in liquid fuels generally, it is especially useful in fuels of the gasoline boiling range — and generally at concentrations of from about 5 to 2000 parts per million by weight (ppm), preferably 15–2000 ppm, more preferably 15–800 ppm, and most preferably 15–400 ppm are used.

Generally a gasoline composition, as for example gasoline A of Table I, to which is added from 5 to 2000 parts per million by weight of Type D concentrate, will comprise from 0.01 ppm to 1800 ppm of the aforedescribed condensation product; from 0.025 ppm to 1800 ppm of a hydrocarbon diluent, preferably an aromatic hydrocarbon; from 0.005 ppm to 1200 ppm of an alkanol having about 6 or more carbon atoms, preferably a $C_6$, $C_8$ and $C_{10}$ alkanol; and from 0.4 ppm to 1260 ppm of a normally liquid hydrocarbon polyolefin having an average molecular weight of from 300–2000, preferably a polybutene. The gasoline composition can additionally contain from 0.005 ppm to 200 ppm of an antirust agent, and from 0.005 ppm to 200 ppm of a demulsifier. Generally a preferred gasoline composition comprises from 3 ppm to 600 ppm of the condensation product; from 0.75 ppm to 450 ppm of the hydrocarbon diluent, preferably an aromatic hydrocarbon; from 0.75 ppm to 450 ppm of the $C_6$ and higher alkanol, preferably a $C_6$, $C_8$ and $C_{10}$ alkanol mixture; and from 6.75 ppm to 850 ppm of the polyolerin, preferably a polybutene. The preferred gasoline composition can additionally contain from 0.015 ppm to 50 ppm of an antirust agent, and from 0.015 ppm to 50 ppm of a demulsifier.

The condensation products described above are also effective as dispersants in hydrocarbon fuels other than gasoline. These fuels include those boiling in the 300° F.–1000° F. range, including residual fuels.

The dispersancy effectiveness of these condensation products was demonstrated using the following test procedure.

One gallon of fuel oil containing synthetic sludge (1.0 g lampblack, 5.0 ml water/gallon of fuel) is circulated through a 100 monel strainer for two hours using a single stage oil burner pump. The strainer is contained in the pump housing. The sludge collected on the strainer after the two hours is then washed off, dried and weighed. The effectiveness of the additive is expressed as percentage reduction in sludge weight compared to the baseline fuel.

Table B

| Fuel Oil Sludge Dispersancy | | | | |
|---|---|---|---|---|
| Test | Concentrate in Fuel oil[1] | Concentration of Additive (PTB)[2] | Sludge Weight | % Reduction in Sludge |
| A | None | — | 113 mg[3] | — |
| B | Type A[5] | 10 | 35.5 mg[4] | 68.7 |
| C | Type A | 15 | 29.6 mg | 73.9 |
| D | Type A | 5 | 75.4 mg | 33.7 |
| E | Commercial[6] "D" | 13 | 19.9 mg | 82.5 |
| F | Commercial "D" | 19.5 | 16.0 mg | 85.9 |

Table B-continued

| Test | Concentrate in Fuel oil[1] | Fuel Oil Sludge Dispersancy Concentration of Additive (PTB)[2] | Sludge Weight | % Reduction in Sludge |
|---|---|---|---|---|
| G | Commercial "D" | 6.5 | 23.2 mg | 79.6 |

[1]Fuel oil was a commercial No. 2 heating oil.
[2]Parts per thousand barrels: 10 ptb = 0.108 grams/gal.
[3]Average of 5 runs.
[4]Average for 2 runs for each of Tests A-G.
[5]Same as composition in Table A.
[6]A commercial fuel oil dispersant.

It is readily apparent from the data in Table B that the condensation product of alkylphenol/aldehyde/amine is an effective sludge dispersant in non-gasoline hydrocarbon fuel.

Claims to the invention follow.

I claim:

1. A concentrate for use in liquid hydrocarbon fuel in the gasoline boiling range comprising I. from 0.20 – 90 percent by weight of the reaction product of A. one mole part of an alkylphenol having the formula:

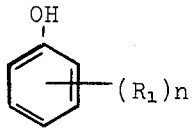

wherein $n$ is an integer from 1 to 2, and $R_1$ is an aliphatic hydrocarbon radical having a molecular weight of from about 400 to 1500;

B. from 1–5 mole parts of an aldehyde having the formula

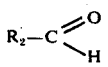

wherein $R_2$ is selected from hydrogen and alkyl radicals containing 1–6 carbon atoms; and C. from 0.5–5 mole parts of an amine having at least one amino group having at least one active hydrogen atom, II. from 0.5 – 90 percent by weight of a hydrocarbon diluent, III. from 0.1 – 60 percent by weight of an alkanol having about 6 to 10 carbon atoms, and IV. from 8 – 98 percent by weight of a normally liquid hydrocarbon polylolefin having an average molecular weight of from 300–2000.

2. A concentrate according to claim 1 wherein said reaction product constitutes from about 20 percent to about 60 percent by weight of the concentrate.

3. A concentrate according to claim 2 wherein said hydrocarbon diluent constitutes from about 5 percent to about 45 percent by weight of the concentrate.

4. A concentrate according to claim 2 wherein said alkanol constitutes from about 5 percent to about 45 percent by weight of the concentrate.

5. A concentrate according to claim 2 wherein said polyolefin constitutes from about 45 percent to about 85 percent by weight of the concentrate.

6. A concentrate according to claim 5 wherein said hydrocarbon diluent is primarily an aromatic hydrocarbon.

7. A concentrate according to claim 5 wherein said polyolefin is polybutene.

* * * * *